US008561426B2

(12) United States Patent
Voorhis

(10) Patent No.: US 8,561,426 B2
(45) Date of Patent: Oct. 22, 2013

(54) CRIMPED ORIFICE FOR FLARE FITTING

(75) Inventor: Roger J. Voorhis, Clarksville, TN (US)

(73) Assignee: Trane International Inc., Piscataway, NJ (US)

( * ) Notice: Subject to any disclaimer, the term of this patent is extended or adjusted under 35 U.S.C. 154(b) by 1234 days.

(21) Appl. No.: 12/228,470

(22) Filed: Aug. 13, 2008

(65) Prior Publication Data

US 2010/0037629 A1 Feb. 18, 2010

(51) Int. Cl.

| | |
|---|---|
| ***F25B 41/06*** | (2006.01) |
| ***G01F 1/42*** | (2006.01) |
| ***F16L 25/00*** | (2006.01) |
| ***F16L 35/00*** | (2006.01) |

(52) U.S. Cl.
USPC ..... 62/511; 62/527; 138/44; 285/334.5

(58) Field of Classification Search
USPC ..... 62/511, 527; 138/44, 109; 285/334.5
See application file for complete search history.

(56) References Cited

U.S. PATENT DOCUMENTS

| | | | | |
|---|---|---|---|---|
| 1,490,123 | A | 4/1924 | Murray | |
| 3,077,903 | A | 2/1963 | Honsinger | |
| 3,167,333 | A * | 1/1965 | Hall et al. | 285/357 |
| 3,411,812 | A * | 11/1968 | Prince et al. | 285/187 |
| 4,029,345 | A * | 6/1977 | Romanelli | 285/334.2 |
| 4,054,157 | A * | 10/1977 | Moseley, Jr. | 138/103 |
| 4,869,290 | A | 9/1989 | Sepso et al. | |
| 5,581,883 | A * | 12/1996 | Matambo et al. | 29/890.054 |
| 6,170,289 | B1 * | 1/2001 | Brown et al. | 62/511 |
| 6,981,511 | B2 * | 1/2006 | Knowles et al. | 137/1 |
| 2002/0029577 | A1 * | 3/2002 | Wightman | 62/222 |
| 2005/0204769 | A1 * | 9/2005 | Oberley et al. | 62/324.6 |
| 2007/0236016 | A1 * | 10/2007 | Kloss et al. | 285/353 |

FOREIGN PATENT DOCUMENTS

| | | |
|---|---|---|
| GB | 795208 | 5/1958 |

* cited by examiner

*Primary Examiner* — Mohammad M Ali
*Assistant Examiner* — Daniel C Comings
(74) *Attorney, Agent, or Firm* — William O'Driscoll

(57) ABSTRACT

A flow restriction or metering device for a refrigerant system includes a crimped or otherwise formed tubular insert that is installed within a standard flare fitting. The flare fitting can be similar to those used for coupling two refrigerant lines, or the fitting can be part of a service valve, such as those used for charging, discharging, or servicing refrigerant systems. The insert provides a fixed orifice having a predetermined flow coefficient. The insert is removably clamped within the fitting and extends into a refrigerant line that connects to the fitting.

8 Claims, 4 Drawing Sheets

CRIMPED ORIFICE FOR FLARE FITTING

FIELD OF THE INVENTION

The subject invention generally pertains to refrigerant systems and more specifically to a flow expansion or flow metering device for such a system, wherein the device provides a fixed orifice.

BACKGROUND OF RELATED ART

Many refrigerant systems for heating and/or cooling include a fixed orifice type of expansion device for metering refrigerant flow.

U.S. Pat. No. 5,581,883, for instance, shows a tubular flow restrictor with a fixed orifice opening. An outer tube is crimped to help hold the flow restrictor in position within the tube, and then the restrictor is soldered in place. Once installed with the outer tube, however, it appears that it would be quite difficult to ever replace the internal restrictor.

U.S. Pat. No. 4,869,290 discloses an expansion device that includes a threaded connection for installing or replacing an internal orifice piston; however the device is relatively complicated due to the piston being movable between a first position to engage a valve seat and a second position to engage a shoulder.

U.S. Pat. No. 3,077,903 discloses a flow control device, particularly useful in water lines. Rather than providing a fixed restriction, however, it appears that the device includes an internal element that deforms under pressure to help regulate the flow rate. Moreover, the device appears to be comprised of custom made parts, which can make such a device more expensive to produce in low quantities.

U.S. Pat. No. 1,490,123 and British Patent 795,208 disclose simple fluid-related devices; however, the devices do not appear suitable for use as a metering device for a refrigerant circuit. The '123 device is a valve bonnet, and the '208 device is a nozzle.

There appears to be a need for a simple, replaceable metering element that can be readily and affordably incorporated in refrigerant systems.

SUMMARY OF THE INVENTION

It is an object of the invention to provide a refrigerant system with a flow restriction, wherein the restriction is created by inserting a tubular insert within a standard threaded fitting.

Another object of some embodiments is to insert a flow-restricting tubular insert into a standard flare tube coupling.

Another object of some embodiments is to insert a flow-restricting tubular insert into a standard service valve.

Another object of some embodiments is to create a flow-metering device by crimping or otherwise deforming a tubular insert.

Another object of some embodiments is to sealingly clamp a flow-restricting tubular insert and a flared tube between two tapered surfaces of a threaded fitting or valve.

Another object of some embodiments is to provide a flow-restricting tubular insert that can fit within the inside diameter of a refrigerant tube.

Another object of some embodiments is to provide a tubular insert with an orifice that can be almost any shape including, but not limited to, round.

Another object of some embodiments is to selectively provide a threaded fitting or valve with any one of a variety of flow-restricting tubular inserts having different flow coefficients.

One or more of these and/or other objects of the invention are provided by a refrigerant flow restriction or metering device that includes a flare tube fitting or valve with an internal tubular insert that is clamped via a threaded connection on the fitting or valve, wherein the tubular insert provides a flow-restricting fixed orifice.

DESCRIPTION OF THE PREFERRED EMBODIMENT

Figure 6:
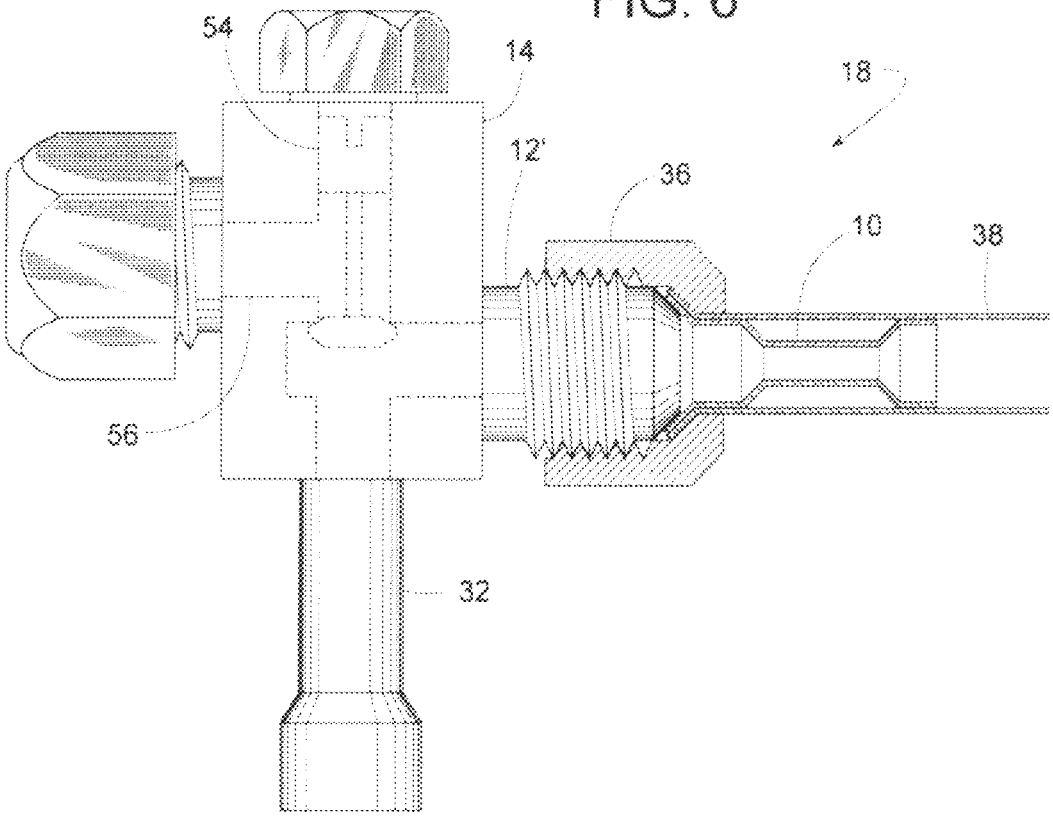
FIG. 6 is a cross-sectional view similar to FIG. 1 but showing the flow restriction being part of a valve.
Figure 7:
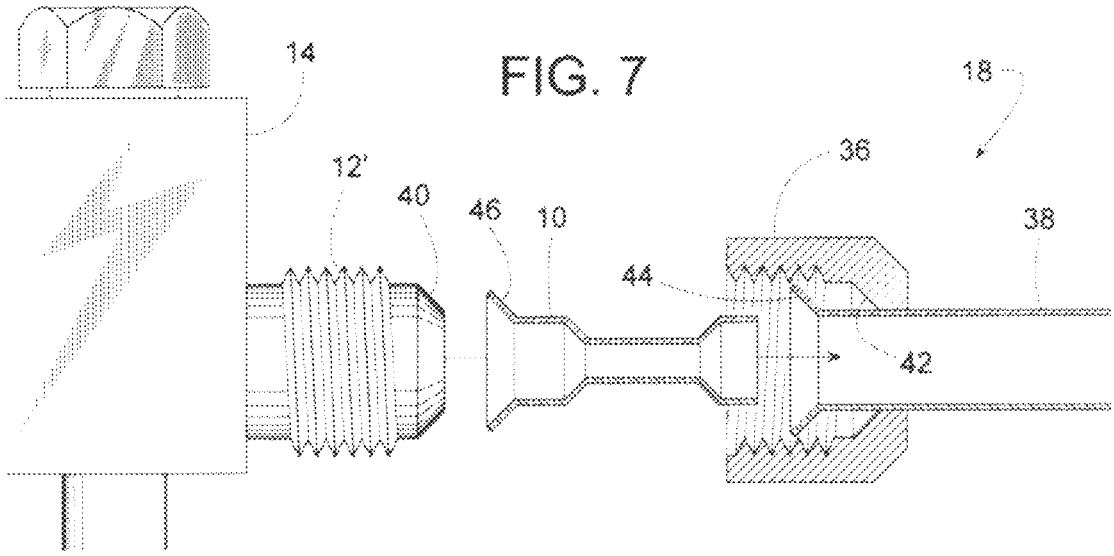
FIG. 7 is an exploded view of FIG. 6.
Figure 8:
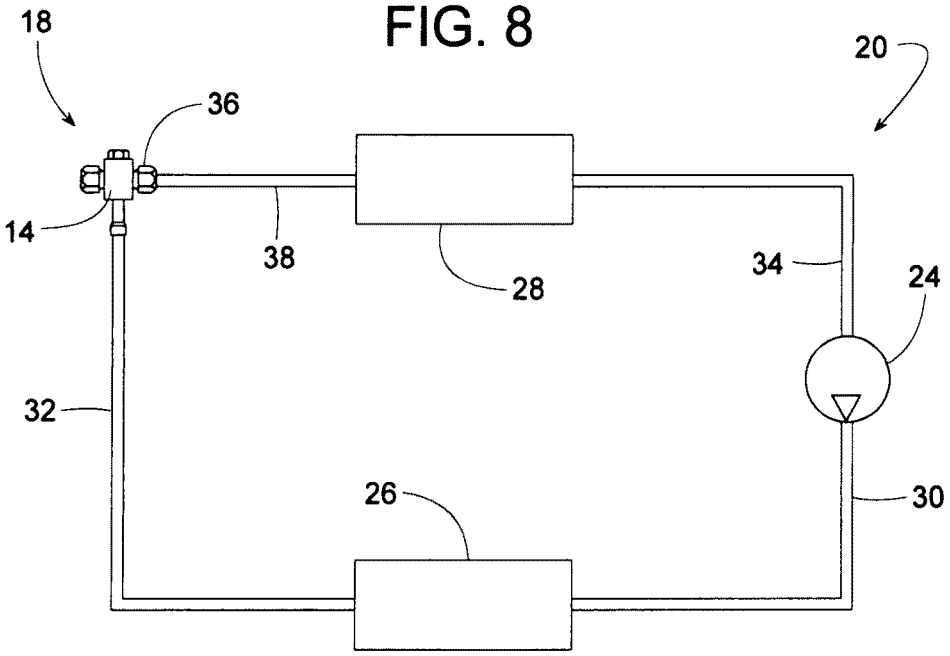
FIG. 8 is a schematic view of a refrigerant system including the flow restriction of FIG. 6.
Figure 9:
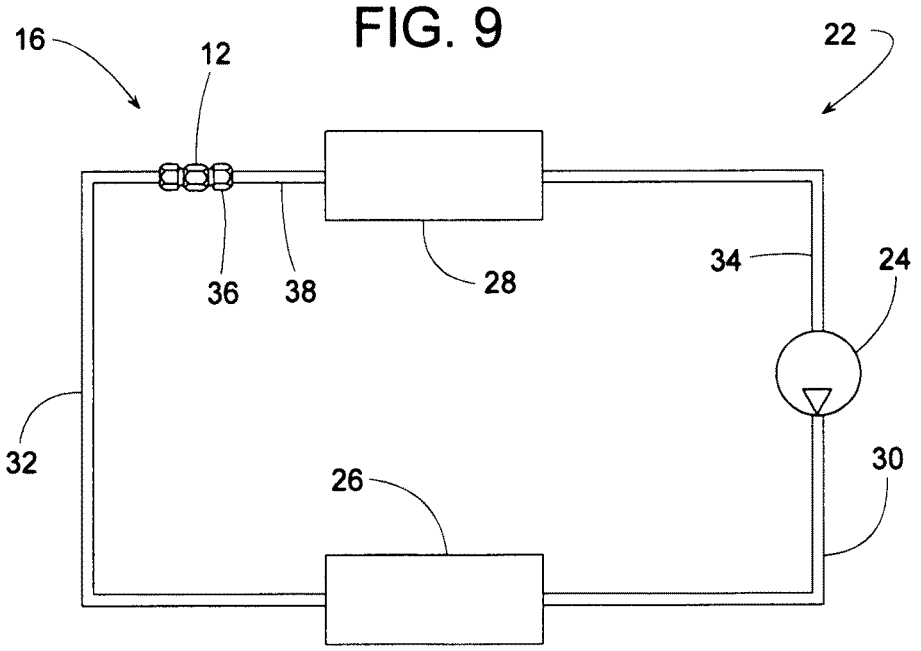
FIG. 9 is a schematic view of a refrigerant system including the flow restriction of FIG. 1.

FIGS. 1-11 illustrate how a flow-restricting tubular insert 10 can be installed in a threaded fitting 12 (FIG. 1) or in a service valve 14 (FIG. 6) to create a metering device or flow restriction 16 or 18 or metering device for a refrigerant system, such as systems 20 and 22 of FIGS. 8 and 9.

Systems 20 and 22 are schematically illustrated to represent any refrigerant system comprising a compressor 24 for compressing a gaseous refrigerant, a condenser 26 for cooling and condensing the refrigerant discharged from compressor 24, flow restriction 16 or 18 for expanding and thus further cooling the refrigerant discharged from condenser 26, and an evaporator 28 for creating a cooling effect provided by the cooled refrigerant. A discharge line 30, a liquid line 32, and a suction line 34 are tubes that connect the various components of systems 20 and 22 each in a closed loop refrigerant circuit. Compressor 24 can be any type of compressor; either condenser 26 and evaporator 28 can be installed indoor or outdoor; condenser 26 can be liquid or air cooled; evaporator 28 can absorb heat from a liquid or gas; and systems 20 and 22 can each operate in a heating mode, a cooling mode, or selectively heat/cool such as in a reversible heat pump.

Figure 1:
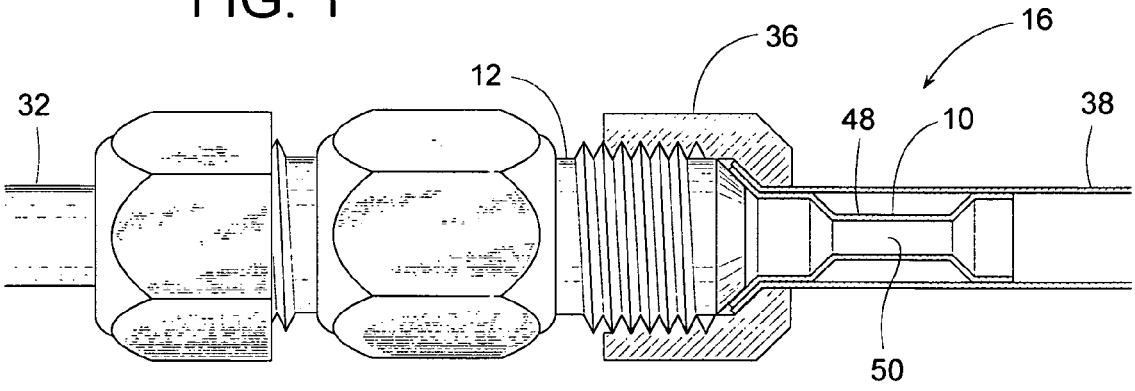
FIG. 1 is a cross-sectional view of a flow restriction for a refrigerant system.
Figure 2:
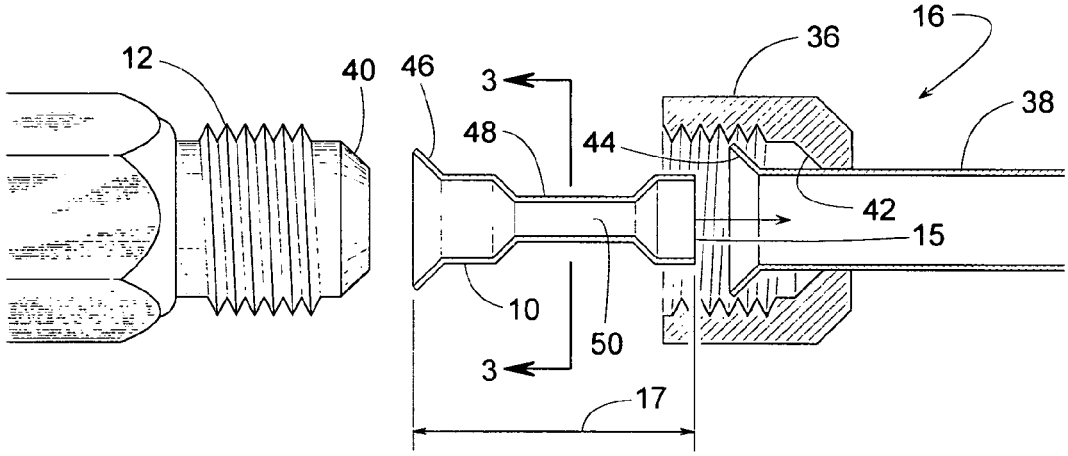
FIG. 2 is an exploded view of FIG. 1.

Referring to FIGS. 1 and 2, flow restriction 16 comprises tubular threaded fitting 12 with a nut 36 for connecting liquid line 32 to a tube 38 that leads to evaporator 28. Fitting 12 provides a conduit for conveying refrigerant from liquid line 32 to tube 38. To create a compact, hermetically sealed assembly with a nesting arrangement of components, fitting 12 includes a beveled end 40, nut 36 includes a tapered surface 42, tube 38 includes a flared tube end 44, and insert 10 includes a flared insert end 46, an open end 15, and a restricted throat (e.g., throat 48, orifice 50, orifice 50' and orifice 50") between ends 46 and 15. FIG. 2 shows tubular insert 10 in a prior-to-insertion position, and FIG. 1 shows tubular insert 10 in an inserted position. FIGS. 1 and 2 also show beveled end 40 being convex, tapered surface 42 being concave, and flared tube end 44 being substantially parallel to both tapered surface 42 and beveled end 40. Regardless of whether tubular insert 10 is in the inserted position (FIG. 1) or the prior-to-insertion position (FIG. 2), tubular insert 10 has an overall axial length 17 that extends beyond (i.e., is longer than) the axial length of the restricted throat.

To assemble flow restriction 16, flared tube end 44 is seated against tapered surface 42 of nut 36. Tubular insert 10 is inserted into tube 38 to bring flared insert end 46 into engagement with flared tube end 44. Nut 36 is then securely screwed onto fitting 12 to compressively clamp flared insert end 46 and flared tube end 44 between beveled end 40 and tapered surface 42.

Figure 3:
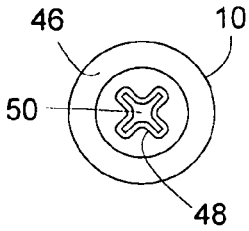
FIG. 3 is a cross-sectional view taken along line 3-3 of FIG. 2.
Figure 4:
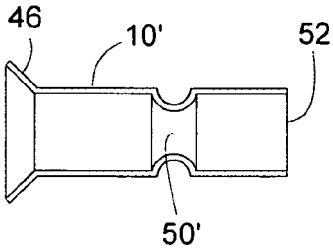
FIG. 4 is a cross-sectional view of an alternate tubular insert.

Insert 10 includes a restricted throat 48 that provides an orifice 50 with a predetermined flow coefficient. The open flow area of orifice 50 can be of almost any imaginable shape such as round or polygonal, wherein the term, "polygonal" refers to any multifaceted geometry or irregular shape. Orifice 50 of FIG. 3 is one example of a polygonal orifice, and FIG. 4 shows an insert 10' with a generally round orifice 50'.

Figure 5:
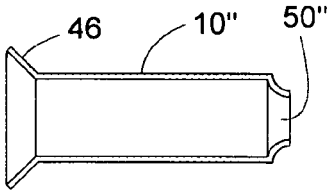
FIG. 5 is a cross-sectional view similar to FIG. 4 but showing a tubular insert of yet another design.
Figure 10:
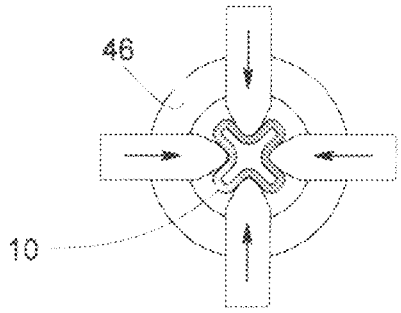
FIG. 10 shows a tubular insert being crimped to create a predetermined orifice.

A polygonal orifice can be produced by mechanically crimping a tubular insert as shown in FIG. 10. A round orifice can be made in a similar manner or by roll forming. Orifice 50' can be formed between an open end 52 and the flared insert end 46, as shown in FIG. 4, or a similar orifice 50" can be formed directly at the open end of an insert 10", as shown in FIG. 5.

Tubular insert 10 can also be installed in a threaded fitting 12' of valve 14, as shown in FIGS. 6 and 7. In this example, valve 14 happens to be a service valve with an actuator 54 for selectively opening and closing a service port 56. Valve 14 and fitting 12 can be installed at any desired location of a refrigerant system, wherein FIGS. 8 and 9 provide two installation examples.

Figure 11:
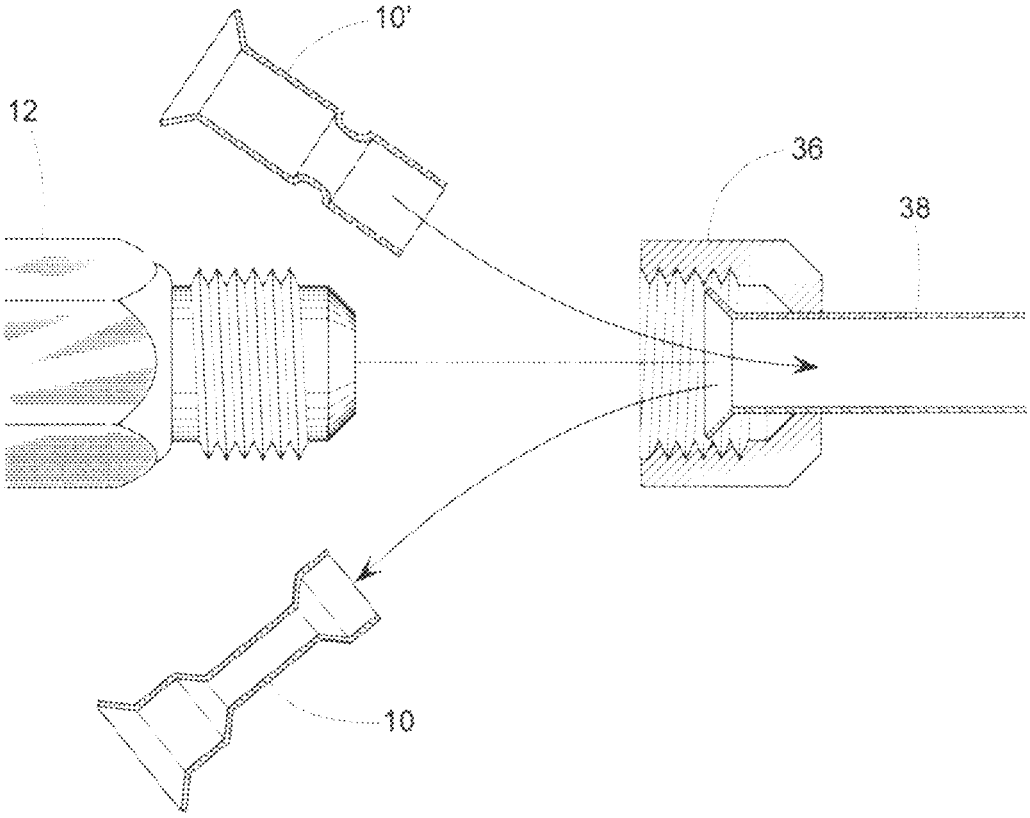
FIG. 11 shows one tubular insert replacing another.

FIG. 11 shows how one tubular insert can replace another. In this example, insert 10' is replacing insert 10, wherein insert 10' provides less flow restriction than does insert 10.

Although the invention is described with respect to a preferred embodiment, modifications thereto will be apparent to those of ordinary skill in the art.

The scope of the invention, therefore, is to be determined by reference to the following claims:

1. A refrigeration system having a flow restriction, the flow restriction comprising:

a threaded fitting having a beveled end that is convex;

a tube that includes a flared tube end;

a tubular insert comprising a flared insert end, an open end and a restricted throat therebetween, the tubular insert having selectively an inserted position and a prior-to-insertion position, the tubular insert in the inserted position extending into the tube, the tubular insert in the prior-to-insertion position being separated from the tube, the restricted throat existing in both the inserted position and the prior-to-insertion position, the tubular insert having an overall axial length that extends beyond the restricted throat when the tubular insert is in the prior-to-insertion position, the overall axial length of the tubular insert also extending beyond the restricted throat when the tubular insert is in the inserted position; and a nut with a tapered surface that is concave and substantially parallel to the beveled end of the threaded fitting, the nut being screwed onto the threaded fitting such that the flared tube end and the flared insert end are compressively clamped between the beveled end of the threaded fitting and the tapered surface of the nut, the flared tube end of the tube is substantially parallel to both the tapered surface of the nut and the beveled end of the threaded fitting.

2. The refrigeration system of claim 1, wherein the threaded fitting includes external threads that threadingly engages the nut.

3. The refrigeration system of claim 1, wherein the tubular insert extends into the tube.

4. The refrigeration system of claim 1, further comprising a valve that includes the threaded fitting.

5. The refrigeration system of claim 4, wherein the valve defines a service port and a manual actuator that selectively opens and closes the service port.

6. The refrigeration system of claim 1, wherein the threaded fitting defines an inlet and an outlet at which the tubular insert is selectively installable.

7. The refrigeration system of claim 1, wherein tubular insert includes an open end such that the flared insert end and the open end are at opposite ends of the tubular insert, and the restricted throat is at the open end.

8. The refrigeration system of claim 1, wherein the restricted throat defines an orifice having a polygonal shape.

* * * * *